US008037820B2

(12) United States Patent
Daniels

(10) Patent No.: US 8,037,820 B2
(45) Date of Patent: Oct. 18, 2011

(54) DECORATIVE, WOOD FIRE-RATED DOOR AND METHOD

(76) Inventor: William Daniels, Sammamish, WA (US)

( * ) Notice: Subject to any disclaimer, the term of this patent is extended or adjusted under 35 U.S.C. 154(b) by 1187 days.

(21) Appl. No.: 11/731,263

(22) Filed: Mar. 29, 2007

(65) Prior Publication Data

US 2007/0245661 A1 Oct. 25, 2007

Related U.S. Application Data

(60) Provisional application No. 60/788,436, filed on Mar. 30, 2006.

(51) Int. Cl.
*B41F 17/00* (2006.01)

(52) U.S. Cl. ..... 101/491; 101/35; 347/101; 52/784.11

(58) Field of Classification Search ..... None
See application file for complete search history.

(56) References Cited

U.S. PATENT DOCUMENTS

| | | | | |
|---|---|---|---|---|
| 3,196,494 | A | 7/1965 | Hartman et al. | 20/15 |
| 3,566,564 | A | 3/1971 | Gaeth et al. | 52/232 |
| 3,811,992 | A | 5/1974 | Handa et al. | 161/267 |
| 4,247,332 | A | 1/1981 | Kinoshita et al. | 106/18.16 |
| 4,462,831 | A | 7/1984 | Raevsky et al. | 106/18.26 |
| 4,811,538 | A | 3/1989 | Lehnert et al. | 52/455 |
| 4,818,595 | A | 4/1989 | Ellis | 428/245 |
| 4,947,606 | A | 8/1990 | La See | 52/455 |
| 6,150,449 | A | 11/2000 | Valkanas | 524/425 |
| 6,881,247 | B2 | 4/2005 | Batdorf | 106/15.05 |
| 2003/0160987 | A1 | 8/2003 | Zumbo | 358/1.9 |
| 2003/0218663 | A1 * | 11/2003 | Baxter et al. | 347/102 |
| 2005/0239931 | A1 | 10/2005 | Bolton et al. | 524/198 |

* cited by examiner

*Primary Examiner* — Joshua D. Zimmerman
(74) *Attorney, Agent, or Firm* — Dean A. Craine

(57) ABSTRACT

A decorative, wood fire-rated door with a graphic or image imprinted or applied to a front or rear face on the door that does not change or impact the door's overall fire-rating. With the use of flatbed or ultraviolet ink printing press machinery, a fine art quality image that utilizes six various colored ultra-violet inks can be applied directly onto the door face used on a fire-rated door. Alternatively, the photographic files can also be produced onto an adhesive backed graphic panel with a protective laminated layer that can be applied directly onto the door surface.

2 Claims, 6 Drawing Sheets

DECORATIVE, WOOD FIRE-RATED DOOR AND METHOD

This is a utility patent application which claims benefit of U.S. Provisional Application No. 60/788,436 filed on Mar. 30, 2006.

BACKGROUND OF THE INVENTION

1. Field of the Invention

This invention pertains to wood doors and more particularly to wood doors that are fire-rated.

2. Description of the Related Art

The interior and exterior doors used in a building can play an important role in the building's appearance. For example, wood doors are often preferred over metal doors because of the warmth and beauty of the wide variety of different woods that can be used and the different types and ornamental rails and panels that can be used.

The building codes promulgated in most municipalities require that all exterior doors and most interior doors used in commercial buildings be fire-rated and meet ASTM standards (ASTM E-152 for neutral pressure testing and ASTM E-2074 for positive pressure testing). Wood fire-rated doors can be very expensive, and due to their costs and certification requirements, are used primarily in commercial buildings with a large quantity of room or entry doors, such as hotels, schools, office buildings or hospitals.

Entry doors to the rooms in a hotel play a prominent role in a hallway's overall appearance. While such doors may be covered with paint, wallpaper, or decorative materials, such materials change the door's fire rating. If the building owner wants to change the visual impact of a door or on the overall appearance of a room or hallway, his or her only recourse is to replace the door with a different style door.

What is needed is a decorative wood fire-rated door that can be manufactured in a wide variety of different colors, graphics or images imprinted on its surfaces.

SUMMARY OF THE INVENTION

It is an object of the present invention to provide a decorative wood door that can be made in different colors, graphics or images.

It is another object of the present invention to provide such a door that is fire-rated.

These and other objects are met by a decorative fire-rated door manufactured by one or two methods disclosed herein. Under the first method, which is used while the door is being manufactured, a wood door face is first selected and then an image is then produced on the door face using one or more ultraviolet inks. Once the inks have cured, the door face is then assembled into the door. One advantage of the first method is that the image can be easily changed and that the amount of ink applied to the door face can be relatively small so that the natural grains of the wood door face remain visible after the ink has cured. This method also does not disrupt the standard manufacturing process of fire-rated doors.

Under the second method which is used after the door has been manufactured, a pre-assembled graphic panel is applied to the desired door-face surface of the door. In the preferred embodiment, the graphic panel includes a thin paper substrate with the desired image first printed thereon. Applied to the back of the paper substrate is an adhesive layer that is protected by a thin film that is removed prior to applying the graphic panel onto the door face. Formed over the graphic panel is a protective, transparent laminate layer. During assembly, the graphic panel is aligned and registered over the door face. Because the second method is used with pre-assembled wood doors, the cost of manufacturing a decorative door using the second method is less than the cost of manufacturing a decorative wood door using the first method. The second method is also useful with doors that are damaged or have imperfections on their door faces or rails.

DESCRIPTION OF THE PREFERRED EMBODIMENT(S)

Figure 1:
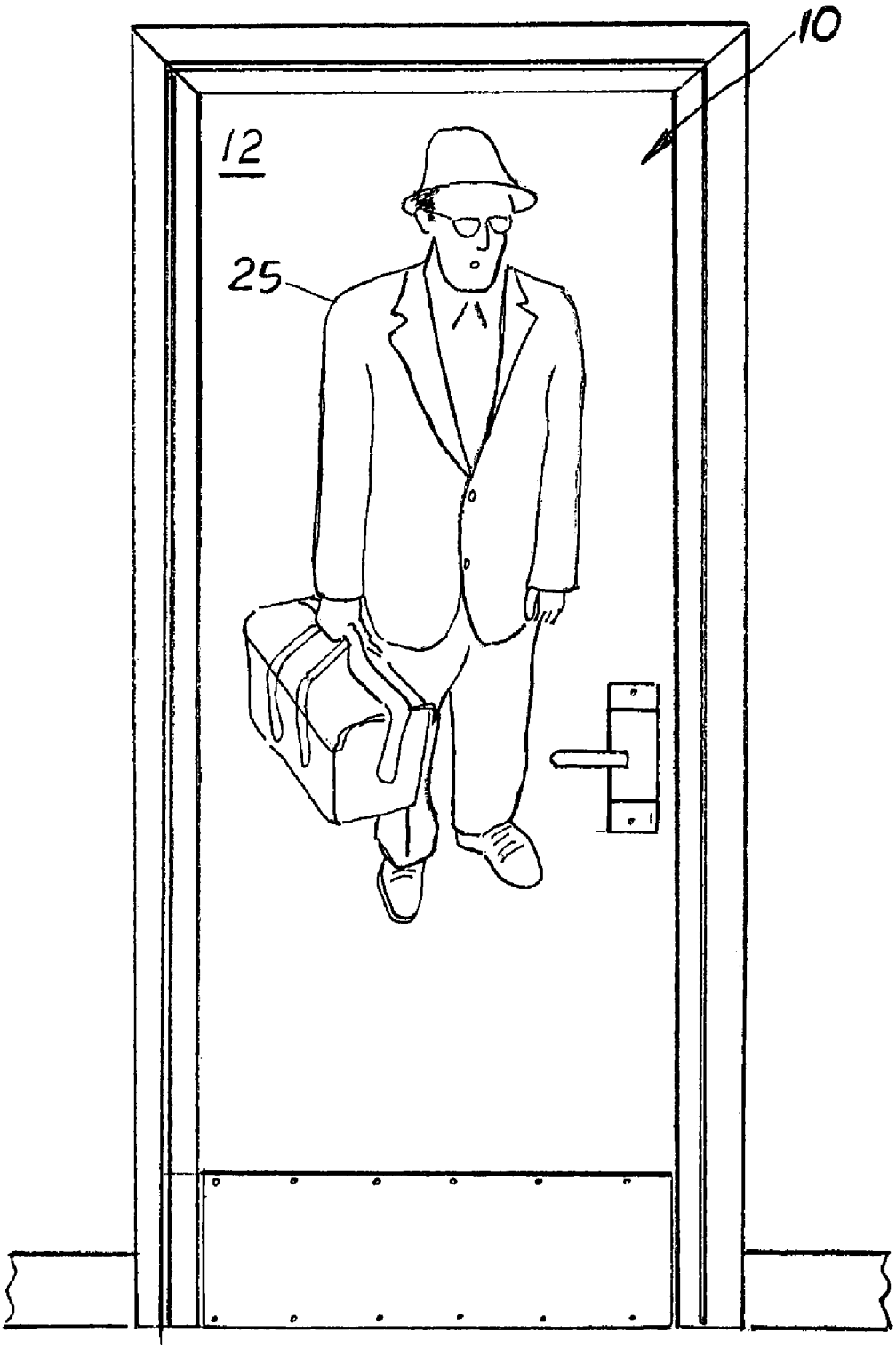
FIG. 1 is front elevational view of a decorative wood fire-rated door prepared by one or two methods disclosed herein.
Figure 2:
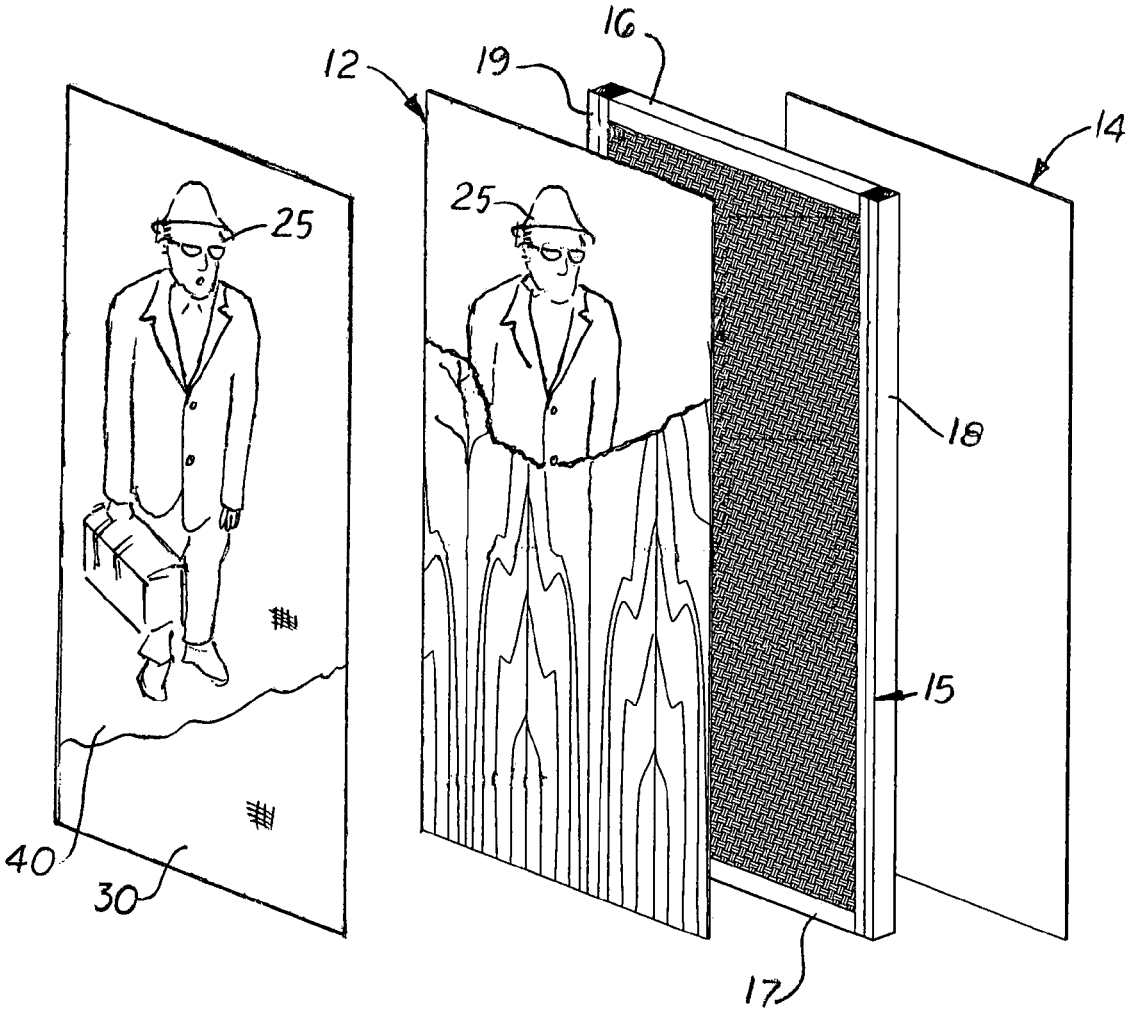
FIG. 2 is a perspective view of a decorative wood fire-rated door showing an image being formed on one of the two methods disclosed herein.
Figure 3:
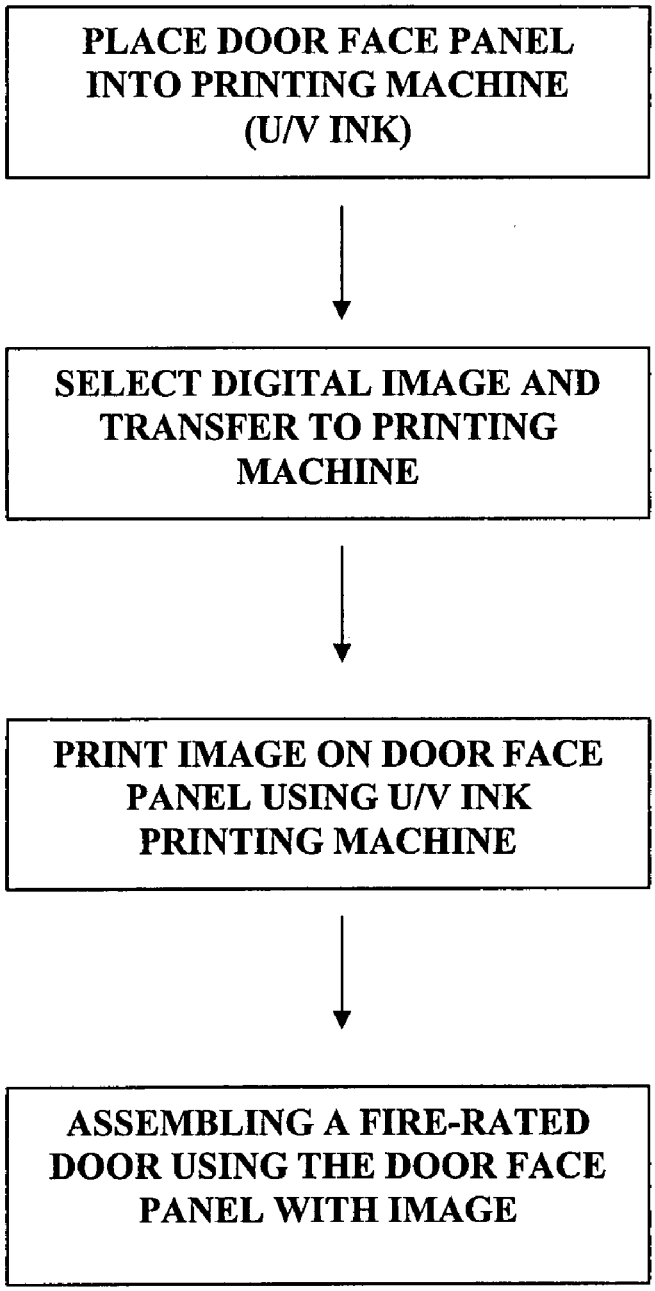
FIG. 3 is a block diagram showing the steps used to manufacture a decorative wood fire-rated door using ultraviolet inks.
Figure 4:
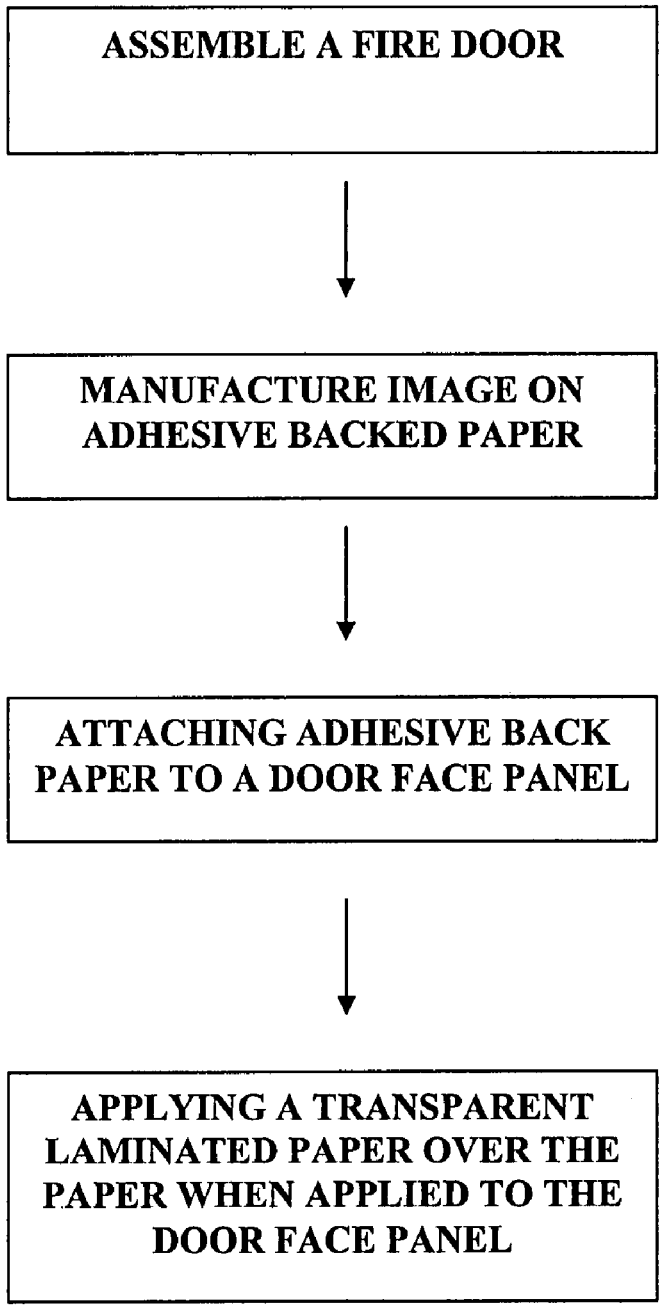
FIG. 4 is a block diagram showing the steps used to manufacturer a decorative wood fire-rated door using an adhesive back paper and laminate film.

Shown in the accompanying FIG. 1, there is shown a decorative fire-rated door 10 produced by one or two methods presented in greater detail in FIGS. 3 and 4. The door 10 includes a front face 12 and a back face 14 that covers a planar core 15. Formed around the edges of the core 15 and the faces 12, 14 is a top rail 16, a bottom rail 17 and two vertical side rails 18, 19. The front and back faces 12, 14 are made of wood veneer of various species. The top and bottom rails 16, 17 are made of solid wood and approximately 1⅛ inches thick while the vertical rails 18, 19 are made of solid wood 1½ inches thick. The core 15 is made of particle board, staved lumber, a structural composite lumber, or mineral composite material. Finished door thickness may vary from 1⅜ inches to 1¾ inches thick.

Under the first method, which is used before the door is manufactured a wood door face 12, 14 is first selected. An image 25 is generated and transmitted to an ultraviolet ink printing press which uses one or more ultraviolet inks that is cured by exposing the door face 12, 14 to an ultraviolet lamp. An example of a machine capable of printing onto a wood's planar substrate is a flatbed plate inkjet printer sold under the trademark PRESSVIEW 200-600 by Vutek, Inc.

Figure 5:
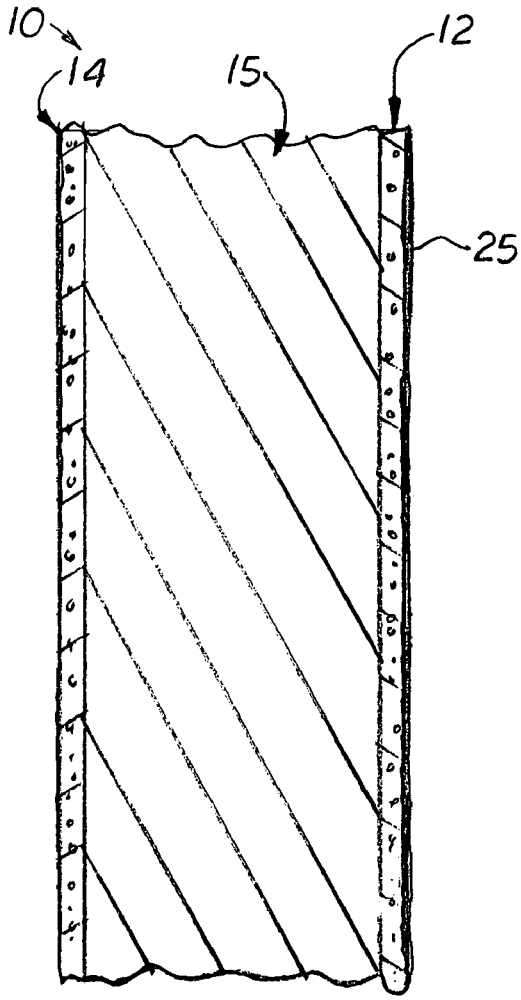
FIG. 5 is a partial sectional side elevational view of a decorative wood fire-rated door produced using the first method described in FIG. 3.
Figure 6:
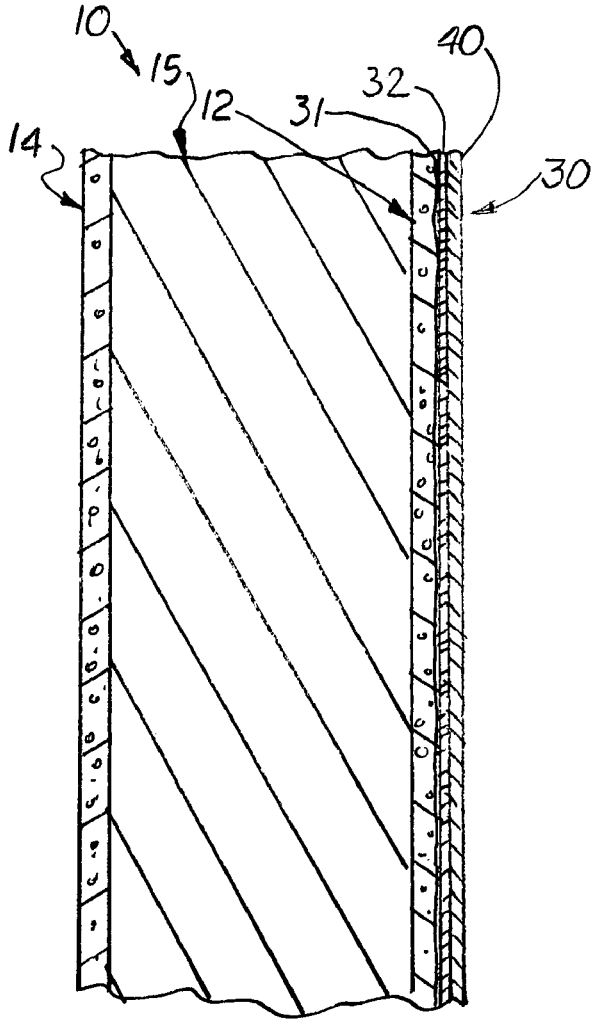
FIG. 6 is a partial sectional side elevational view of a decorative wood fire-rated door produced using the second method described in FIG. 4.

Once the image 25 is transferred to the door face 12, 14, it is then inserted into the ultraviolet ink printing press. The front and rear faces 12, 14 are then attached to the planar core 15 (see FIG. 5). One advantage of the first method is that the amount of ink applied to the door face 12, 14 is relatively small so that the natural wood grains of the door face 12, 14 are visible in the door face 12, 14 and the ink has cured forming a fine art quality graphic image.

Figure 7:
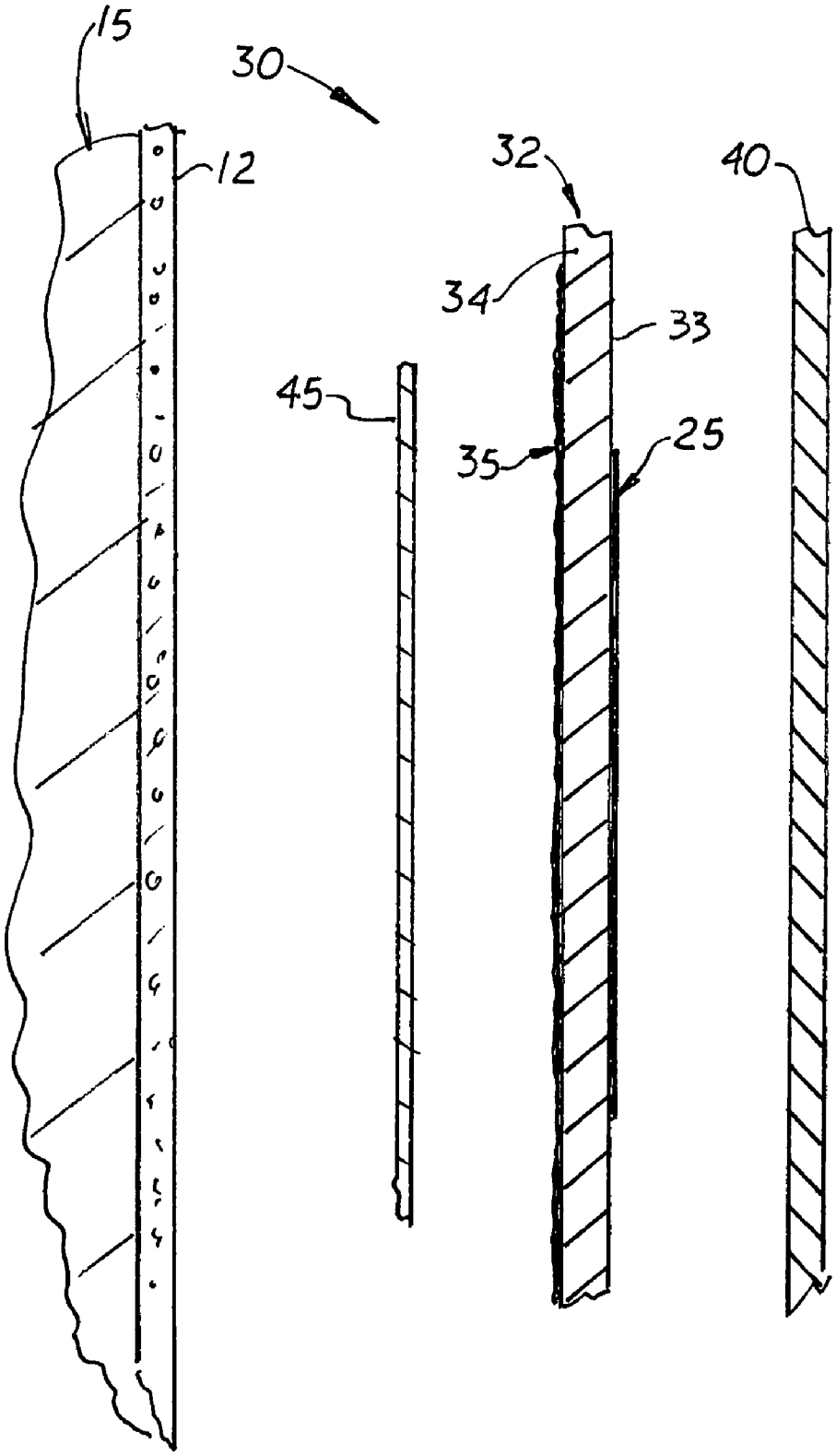
FIG. 7 is an exploded cross-sectional view of the paper substrate used on the decorative wood fire-rated door.

In the second method, used after the door 10 has been manufactured, a graphic panel 30 is first manufactured. As shown in FIG. 7, the graphic panel 30 includes a paper substrate 32 with the graphic image 25 printed on its front surface 33. The paper substrate 32 includes a back surface 34 covered with an adhesive layer 35. Formed over the front surface 33 of the paper substrate 32 and the graphic image 25 is a transparent laminate layer 40. In the preferred embodiment, the graphic image 25 is printed on the front surface 33 of the paper substrate 32 and then the laminate layer 40 is applied over the front surface 33 to protect the graphic image 25. A protective film 45 is applied to cover the adhesive layer 35. The protective film 45 is then removed and the entire assembly that includes the paper substrate 32 and the laminated layer 40, are aligned and registered over the front surface 12. Alternatively, the graphic image 25 may be first printed on the front surface 33 of the paper substrate 32. The adhesive layer 35 is then removed from the paper substrate 32 and the paper substrate 32 is then applied to the door 10. The laminate layer 40 is then applied over the graphic image 25.

Because the second method is used with existing doors, the overall cost of the door using the second method is less than the cost of doors manufactured using the first method. The second method is also useful with doors that are damaged or have imperfections on the door surfaces.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A method of producing an industry code satisfying wood, fire-rated door with a replaceable face that has a decorative image printed thereon that enables the entire door when assembled to retain its industry code fire rating, said method comprising the following steps:

a. selecting an industry code rated, wood, fire-rated door that uses a replaceable face;
b. selecting an image to be produced on said face used on said wood, fire-rated door;
c. selecting an ink printing machine;
d. transferring said image to said ink printing machine used to produce said selected image on said face to be used on said wood, fire-rated door;
e. producing said image using said ink printing machine on said face; and,
f. assembling said face with said image on said wood, fire-rated door.

2. The method of claim 1, wherein said ink printing machine uses an ultraviolet ink.

* * * * *